United States Patent [19]

Eiteljorg, II

[11] Patent Number: 4,638,578

[45] **Date of Patent: * Jan. 27, 1987**

[54] SKI BOOT

[76] Inventor: Harrison Eiteljorg, II, 541 E. Hector St., Conshohocken, Pa. 19428

[ * ] Notice: The portion of the term of this patent subsequent to Apr. 16, 2002 has been disclaimed.

[21] Appl. No.: 723,865

[22] Filed: Apr. 16, 1985

Related U.S. Application Data

[63] Continuation-in-part of Ser. No. 450,764, Dec. 17, 1982, Pat. No. 4,510,703.

[51] Int. Cl.[4] ..... A43B 5/04

[52] U.S. Cl. ..... 36/119; 36/120; 36/121; 24/68 SK

[58] Field of Search ..... 36/58.5, 117, 118, 119, 36/121, 120, 125; 24/68 SK, 70 SK, 69, 70

[56] References Cited

U.S. PATENT DOCUMENTS

| | | | |
|---|---|---|---|
| 722,069 | 3/1903 | Wilt | 36/58.5 |
| 892,760 | 7/1908 | Nelson | 36/58.5 |
| 2,531,763 | 11/1950 | Andre | 36/119 |
| 3,235,981 | 2/1966 | Kloss | 36/58.5 |
| 3,389,813 | 3/1968 | King | 36/58.5 |
| 3,408,754 | 11/1968 | Kueter . | |
| 3,522,668 | 8/1970 | Fesl | 36/119 |
| 3,529,368 | 9/1970 | Confield . | |
| 3,538,627 | 11/1970 | Labat Cony . | |
| 3,599,351 | 8/1971 | Check . | |
| 3,657,827 | 4/1972 | Rieker | 36/117 |
| 3,718,994 | 3/1973 | Spier | 36/117 |
| 3,758,965 | 9/1973 | Caberlotto | 36/117 |
| 3,798,800 | 3/1974 | Rathmell | 36/120 |
| 3,849,914 | 11/1974 | Bertele . | |
| 3,854,743 | 12/1974 | Hansen . | |
| 3,883,964 | 5/1975 | Check | 36/119 |
| 4,006,543 | 2/1977 | Post | 36/121 |
| 4,096,550 | 6/1978 | Seidel | 36/120 |
| 4,160,332 | 7/1979 | Salomon . | |
| 4,190,970 | 3/1980 | Annovi . | |
| 4,192,087 | 3/1980 | Salomon . | |
| 4,222,184 | 9/1980 | Kostinger | 36/121 |
| 4,245,410 | 1/1981 | Molitor | 36/117 |
| 4,253,251 | 3/1981 | Salomon | 36/119 |
| 4,280,286 | 7/1981 | Sartor . | |
| 4,308,674 | 1/1982 | Tessoro . | |
| 4,387,517 | 6/1983 | Annovi | 36/117 |
| 4,561,196 | 12/1985 | Petrini | 36/120 |

FOREIGN PATENT DOCUMENTS

| | | | |
|---|---|---|---|
| 0057170 | 11/1982 | European Pat. Off. | 36/117 |
| 2335679 | 7/1973 | Fed. Rep. of Germany | 24/69 SK |
| 2045321 | 2/1971 | France . | |
| 2075412 | 10/1971 | France . | |
| 8101645 | 6/1981 | World Int. Prop. O. | 36/121 |
| 8302397 | 7/1983 | World Int. Prop. O. | 36/121 |

OTHER PUBLICATIONS

Bulletin Official de la Propriete Industrielle.

*Primary Examiner*—Werner H. Schroeder
*Assistant Examiner*—Mary A. Ellis
*Attorney, Agent, or Firm*—Steele, Gould & Fried

[57] ABSTRACT

A boot for wear while skiing or skating has a sole block for attachment to a ski binding or the like, a first part forming a partial enclosure affixed to the sole block and forming sides, a toe and a rear portion of a boot, enclosing the user's foot and lower leg but for the upper portion of the instep and front of the shin. A second part forms a partial cover removably attachable over the first enclosure to define a protective covering for weatherproofing. The user's foot and leg are structurally affixed only to the first enclosure part. A lower belt is attached to the sole block and crosses the user's instep. An upper belt surrounds the user's shin, attaching the same to the upper rear part of the boot.

11 Claims, 10 Drawing Figures

SKI BOOT

CROSS REFERENCE TO RELATED APPLICATION

This is a continuation-in-part co-pending application Ser. No. 450,764, filed Dec. 17, 1982 and now U.S. Pat. No. 4,510,703, the disclosure of which is hereby incorporated.

BACKGROUND OF THE INVENTION

1. Field of the Invention

This invention relates to the field of footwear, and in particular to a boot for skiing, having a sole attachable to a ski and an upper portion engaging the user's foot and lower leg.

2. Description of the Prior Art

Boots for skiing, skating and the like are intended to affix a user's foot and lower leg comfortably to a ski, rollerskate wheel chassis, ice skate blade or the like. Steering motions, namely tilting of the longitudinal axis of the lower leg from side to side over the ski or skate, must be accurately transmitted to the blade or wheel mounting for good steering control. Tilting motions forward and backward do not directly affect steering, but may have other effects. Fatigue can be reduced by use of a boot which provides some support in a forward-backward direction, allowing the user to assume a comfortable position, for example, leaning forward or backward against the resilience of the boot.

In order to convey side-to-side tilting movement precisely, the means of attachment between the ski and the user's lower leg must be substantially rigid in a side-to-side plane. The prior art includes ski boots adapted to attach a user's leg and a ski, using a hard sole block rigidly attachable to a ski and having structure for fixing the sole block with respect to a point on the user's shin, spaced from the ski. For the most part, such devices are standard boots having no specially-adapted means for fixing the user's foot and ankle with respect to the sole block and boot-leg, that improve over the usual foot-enclosing, shoe-like lacing or clamping structures well known in the art of shoes of the general-purpose variety.

Skate structures are most frequently simple shoes with extending uppers, the usual leather sole being more-or-less permanently attached to a metal blade-or-wheel support plate. Nevertheless, some of the same considerations apply to skis and skates. For purposes of convenience, the present application discusses the matter with respect to skis.

Ski boots having hard molded plastic shells have been known in the art for some years. These boots have means to rigidly attach a hard molded plastic structure to a ski, thereby providing a relatively rigid connection between the boot and the ski. A sole block is molded monolithically with an upwardly-extending shoe portion. The shoe may be integral with a lower-leg enclosure, or the boot may be articulated at the ankle. The leg or upper portion attachable to the user's foot and lower leg in the usual manner, i.e., the boot parts enclose the foot and leg. In an articulated structure, it is also known to provide adjustable spring biasing to set the extent to which the user can lean freely forward and backward on the ski.

Relatively rigid hard plastic material for ski boots and the like is a substantial improvement over previous materials, but the means for attaching such boots to the user's leg have not kept pace. Substantially the same attachment means employed with regular shoes are often applied to ski boots and skates. For example, regardless of use of hard shell material, ski boot structures often include flaps which, although themselves stiff, are brought together and/or caused to slide over one another as a means to reduce the circumference of a part of the boot to which the flaps are attached. The boot is cinched down on the user's foot or leg. This structure and the method of affixing a boot to a foot is much the same as bringing together opposite sides of a shoe by means of laces. Similarly, the prior art uses bails having a series of spaced attachment points, the bails being affixable to bring opposed portions of the boot closer to one another. Of course bail-type latching means and the like result in an attachment for the boot and leg that is rigidly fixed.

It is important in ski boots and ice skates to achieve a secure connection between the leg and boot in order to most effectively transmit the steering movements. Excessive tightening and/or cinching of boot portions without regard to the location of restrictions will impede blood circulation; inadequate tightening and/or misplaced restrictions will allow a relative displacement between the boot and the user's leg and/or foot, detracting from precision of steering movements. Users often also tighten the boots to reduce fatigue, i.e., using the rigidity of the boot to hold themselves in position with respect to the ski or skate.

It has been popular to attach a molded hard plastic boot to a user's foot by forming a custom-molded inner boot in a standard sized hard shell. The user's foot is used as a part of the mold, curable material being poured into a shell around the user's foot. The curable material conforms to the foot dimensions and the hard outer shell can be chosen from one of a series of standard dimensions. The moldable inner material is conveniently thermally-insulating and at least semi-rigid for support. Currently, foam pads in precise sizes are more popular than custom moldings mounted within hard outer shells. Such boots are similar to custom-molded inner boots in that correctly-sized semi-rigid insulating material is positioned between a hard shell of standard dimensions and the user's foot. The foam pad structure, however, does not require special molding equipment or the like in order to provide a custom fit. These methods and apparatus indicate the prior art's emphasis on precision of fit.

Whether made by molding or otherwise, custom boots may fit absolutely perfectly when made, but cannot remain perfect under even the best of conditions. Even a given user's foot will vary in size over time. Moreover, even assuming that such variations in size were minimal, the semi-rigid lining material will become worn and crushed during use as a result of the user's motions of walking, skiing, skating, etc. Normal use gradually enlarges the space allowed for the user's foot. Therefore, the prior art invariably also provided means for adjustably tightening the fit of even custom boots. Of course, greater tightening accelerates the wear on custom pads or molded forms.

Several known tightening means include bail devices, usually in the form of pivotal loops adapted to fit into any of the series of spaced hooks; adjustable pressure-exerting plates movable, for example, by means of screws; belt members extending through the surface of a boot and connecting an internal restriction to an external adjustment means, and the like. Adjustment means of the known kind are useful in allowing the user to offset changes in foot size due to swelling, shrinkage or boot wear, but the adjustment device itself increasingly becomes the structural attachment means by which the user's foot is attached to the ski. The prior art has conceived of various boot designs; however, it should be appreciated that the adjustment means is at least as important as the boot design because it will inevitably become a primary structural support.

Inadequacies and variations in fit are aggravated by closures or tighteners that must be set at a chosen one of a series of discrete intervals. The user may find that the boot is too tight at one position and too loose at the next. Similarly, the user may wish a tighter fit for some circumstances than for others. If the boot is set at the tighter of the available choices, the tightening mechanism rather than the remainder of the boot structure is the primary support that in the end must accomplish all the objects of the boot. The precision of the original fit is of no consequence.

If a boot is loose, the user loses a measure of control of steering the skis or skates, due to a loss of steady control over the precise tilt applied from side-to-side. As a further result of such looseness, a relative movement is permitted between the user's foot and/or leg and various members of the boot, thereby abrading the user's leg. This is particularly a problem between the front upper edge of a boot and the user's shin. Either a hard plastic portion or an insulating foam portion will cause discomfort if rubbed against the skin at the top edge of the boot. Relative movement can be minimized by tightening the boot, but if the boot becomes too tight, the user will be uncomfortable for that reason and may develop frostbite due to inadequate circulation. Whether too tight or too loose, poor fit also causes blisters.

The fit of ski boots affects the incidence of accidents. Loose boots are more difficult to steer, whereby the user is less able to avoid obstacles. Loose boots also do not support the wearer's bones and joints well during falls, leading to more frequent breaks and strains. A loss of circulation due to over-tightening can numb the user's feet resulting in frostbite. The numbness may also prevent the user from feeling subtle tactile clues such as differences between snow surfaces or the like.

The present invention provides a means by which the user's foot and lower leg are custom fitted to a relatively-rigid bottom and back portion of the boot, partially enclosing the user's foot and lower leg. This portion may be articulated, but in any case, the user's foot and lower leg are respectively attached to the sole and leg of the boot, and rigidly supported on the sole block in the side-to-side plane. A protective front portion closes the boot to snow and moisture. The foot is attached to the sole, and the leg to the back of the boot, by means of belts perpendicularly extending over the foot and leg, respectively, spaced from the ankle.

The front cover is preferably a flexible fabric that "breathes", i.e., allows water vapor to escape, such as that sold under the name Gore-tex. Unlike the prior art, the boot does not close tightly against the user's leg, but nevertheless provides full support. The bottom and back-mounted adjustment belts are continuously-adjustable rather than adjustable only at one of a series of discrete intervals. Preferably, the attachment belts both use hook and pile fasteners ("Velcro") or the like. A similar fastening means may be employed for the flexible front covering fabric. The attachment belts are fixed to the inner surfaces of the boot at spaced points, securing the user's foot and leg to the bottom and rear of the boot, respectively.

The structural and protective features according to the invention, but for the waterproof front fabric piece, are associated entirely with the rear/sole part of the enclosing structure. The user's leg can be spaced from the front to preclude abrasion. Problems with variation and fit are minimized.

SUMMARY OF THE INVENTION

It is an object of the invention to provide a boot which substantially rigidly attaches the user's leg to a ski or similar steerable device, in at least a side-to-side plane.

It is also an object of the invention to provide a boot which is comfortable yet tight fitting when new, and still fits tightly and comfortably as the boot wears.

It is another object of the invention to maximize comfort in a ski boot which attaches the user's foot to a ski or the like, and at the same time to minimize the expense and complication of the boot construction.

These and other objects are accomplished by a boot for wear by a user, having a sole block for attachment to a binding, a first member defining a partial enclosure rigidly attached to the sole member and forming sides and a rear of the boot, and a second member defining a cover, removably attachable to the first member. The partial enclosure and cover come together to enclose the user's foot and lower leg. Two attachment belts encircle the foot and lower leg, respectively. The two belts are mounted to extend over the user's instep and over a place on the user's lower leg spaced from the sole portion. The belts are attached only to the sole and rear portions, respectively, i.e., to the first member.

BRIEF DESCRIPTION OF THE DRAWINGS

There are shown in the drawings the embodiments which are presently preferred. It should be understood, however, that the invention is not limited to the precise arrangements and instrumentalities shown therein.

DETAILED DESCRIPTION OF THE PREFERRED EMBODIMENTS

Figure 1:
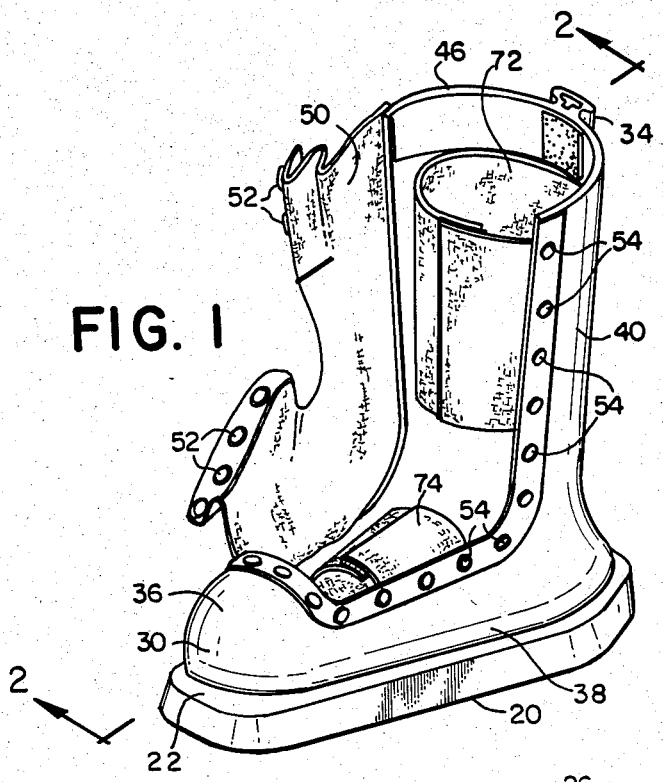
FIG. 1 is a perspective view of the invention as applied to a ski boot.

The boot of the invention conforms externally to the traditional boot shape, that is, to the general "L" outline of the user's foot and lower leg. The boot serves to attach the user's foot and lower leg to a ski binding, or similar device such that relative tilting movement is precluded from side-to-side, but allowed at least somewhat fore-and-aft. A sole block 20, as shown in FIG. 1, is cut sharply around its edges 22, providing protruding means for secure engagement by a ski binding or the like (not shown). The user's foot is affixed within the boot and the boot is affixed to the ski.

The boot of the invention depends structurally upon a first member forming a partial enclosure of the user's foot, that is, an enclosure that reaches around the bottom, rear and sides of the user's foot and lower leg. The second member, which is removably attachable at the front and top of the leg and foot, is adapted for encircling the foot and leg for weather protection rather than structural support. Two attachment belts serve to attach the user to the first member.

Referring to FIG. 1, the portion of the boot forming the first member, namely, partial enclosure 30 including sole block 20, toe 36, foot-surrounding sides 38 and leg-surrounding sides 40, may be molded integrally of hard plastic. This partial enclosure 30 is a complete boot but for the top of the foot and front of the leg areas. Thermal insulation 70 is provided around the inner surfaces of part 30 to protect the user's foot and lower leg 26, shown in phantom in FIG. 2, from loss of heat through the hard plastic. Suitable thermal insulation is also provided in the cover portion 50.

According to the invention, the user's foot is securely mounted to sole block 20 by means of a foot-encircling continuously-adjustable belt 74. Belt 74 is preferably a wide, substantially inextensible material mounted to sole block 20 at spaced points and having mating hook and pile fastener surfaces attaching the opposed sides of the belt to one another over the user's instep. Belt 74 is effective to fix the user's foot to sole block 20 in a vertical direction, extending perpendicularly upward from sole block 20. The belt is closed by means of hook and pile strips ("Velcro"), thereby permitting some misalignment of the belts over the instep as required to accommodate the sloping surface of the user's instep. In this manner, the foot is also secured, to some extent, in a forward/backward direction. Belt 74 is spaced forward from the ankle/heel area at the rear of the boot.

Figure 8:
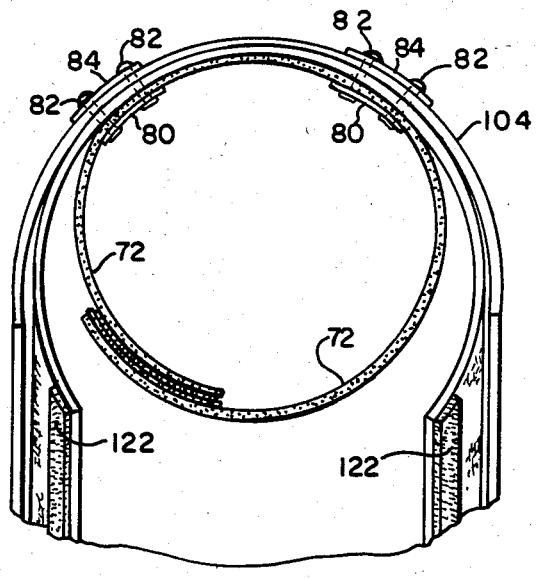
FIG. 8 is a partial plan view of the embodiment of FIG. 3, with front cover removed.

Upper belt 72 similarly attaches the user's lower leg to the hard molded part 30 of the boot. The attachment of belt 72 can be made at a plurality of places along the rear spine of the boot, or at points spaced from the center line similar to that used for belt 74, as shown in FIG. 8. Belt 72 also has mating hook and pile fastening strips along the opposing free edges, whereby a continuously-adjustable attachment is achieved, allowing for misalignment due to the non-cylindrical shape of the user's leg and foot. Belts 72, 74 are preferably wide in order to affix the user's leg to the hard plastic part 30, securely yet comfortably, having a wide area of effective contact.

One or more reinforcing bars 34 may be molded into the boot, for example along the rear spine. Spine reinforcement 34 maintains a predetermined rigidity of the leg part, and is preferably bent to conform to the natural contour of the user's leg and heel. The spine 34 itself can also be made straight.

Inasmuch as the top of the foot and front of the leg are exposed, hard molded or structurally-supporting part 30 extending only over the bottom, sides and back of the foot, a protective front cover 50 is provided to close the remaining surface over and in front of the user's foot and leg. Cover 50 is primarily useful for warmth and for excluding snow. Cover 50 may be formed of a fabric adapted for allowing passage of water vapor, but tightly woven to exclude liquid water. Such a fabric is currently sold under the name "Goretex". Fasteners 52 are provided on cover 50, for mating with complementary fasteners 54, located around the periphery of the opening in the front and top of the boot. Fasteners 52 may be, for example, mating strips of Velcro, zippers, snaps or the like.

When putting on the boot, the user merely separates cover 50 from part 30, opens belts 72, 74 and places his or her foot against the back and bottom of the boot. Belts 72, 74 are then closed tightly over the instep and skin, and cover 50 is closed. Belt 72 effectively affixes the user's lower leg 26 to the partial enclosure 30, exerting a rearward pressure perpendicular to the spine or longitudinal axis of the leg, at a point spaced above the sole block area. Belt 74 exerts a downward pressure perpendicular to the sole block at a point spaced forward from the ankle. The boot parts and belts reinforce the user's foot, leg and ankle with the structure of the boot.

In normal movement, the user's foot will pivot forward and backward around the ankle to an extent now limited by the reinforcing structure. Cover 50 encloses the user around the top and front, however, the belt 72 prevents the user's leg from tilting forward with respect to the boot, being held to the rear by belt 72, and downward by belt 74.

Figure 2:
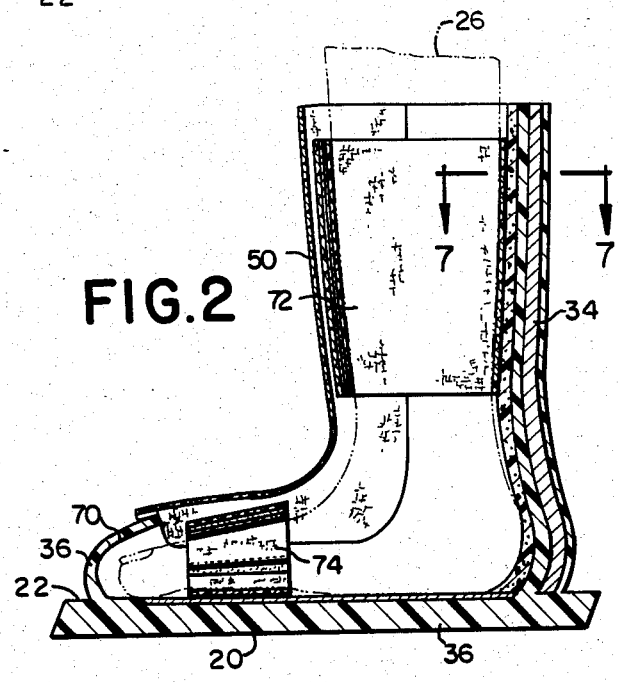
FIG. 2 is a section line taken along lines 2—2 in FIG. 1, the user's foot being shown in phantom.
Figure 3:
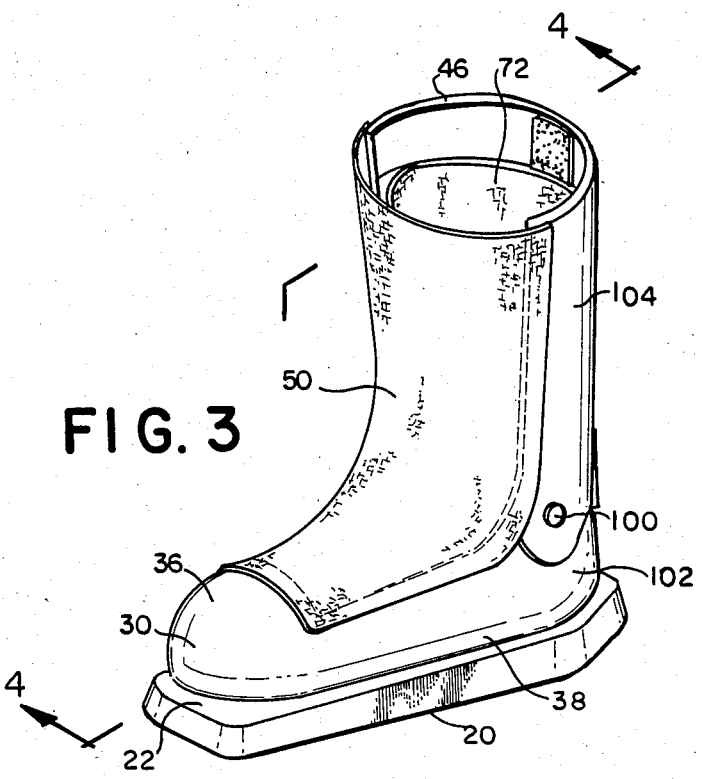
FIG. 3 is a perspective view of an alternative embodiment of the boot, shown closed.
Figure 4:
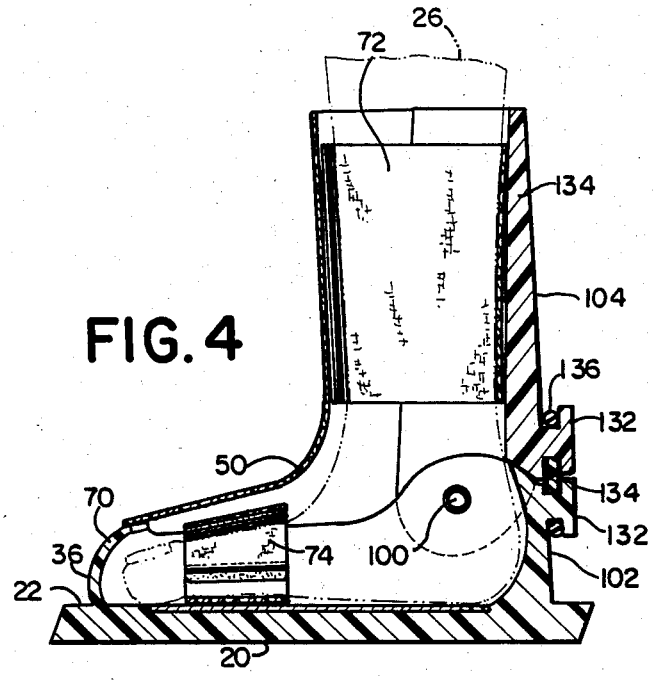
FIG. 4 is a section view taken along lines 4—4 in FIG. 3.

Spine 34 can be chosen for appropriate resilience. In place of, or in addition to reinforcing spine 34 as shown in FIGS. 1 and 2, the invention can also be applied to articulated boots having a horizontal pivoting axis corresponding to the user's ankle joint. In FIG. 3, an articulated boot is shown having cover 50, also closed by means of fasteners (not shown) attaching the edges of cover 50 to the edges of bottom/rear partial enclosure 30. As shown in FIGS. 3 and 4, hinge joint 100 may be a simple pivot joint whereby molded portion 30 is articulated into a shoe portion 102 and a leg portion 104. An integrally-molded pin 106, for example, molded onto and extending horizontally from shoe portion 102 along the axis of the user's ankle, engages a hole 108 in leg portion 104, the leg portion overlapping the shoe portion. According to this structure, side-to-side movements are precisely transmitted between the user's leg 26 and the ski, skate or other structure attached to sole block 20 because the hinge pivots forward/backward only. The user is free to lean forward and backward, within certain limits, by means of the articulated structure.

The freedom of movement in a forward and backward plane can also be advantageously restricted providing a resilient urging to maintain the leg part upright, against which the user can lean. The restriction can be accomplished in various ways including resilient springs, pads, bands and the like. A preferred connection, for example, includes mating helically inclined planes on foot part 102 and leg part 104 adjacent pivot joint 100. As the leg portion rotates forward, the inclined planes urge the leg part and foot part to separate along the hinge axis. The parts 102, 104 being resilient, the leg part 104 is urged to remain upright.

Another alternative is shown in FIG. 4. Flanges 132 protrude rearwardly from both the shoe portion 102 and leg portion 104. Between flanges 132, pad 134 restricts the extent to which leg portion 104 can rotate backward around hinge joint 100, which rotation compresses pad 134 between flanges 132. Pad 134 can be a soft or hard rubber material, as selected by the user. An encircling band 136, for example a resilient O-ring or like band, urges the flanges 132 toward one another, restricting rotation of leg portion 134 forward around hinge 100. Although the freedom to lean forward and backward is determined by the resilience of pad 134 and band 136, the structure shown will be displaceable further toward the front than the rear, the latter being ultimately limited by abutment of flanges 132. The embodiment of FIG. 4 does not also include a reinforcing spine member along the leg portion 104, which function is met by the flanges, pad and band, belt 72 being affixed directly to the plastic at points spaced from the spine.

Figure 5:
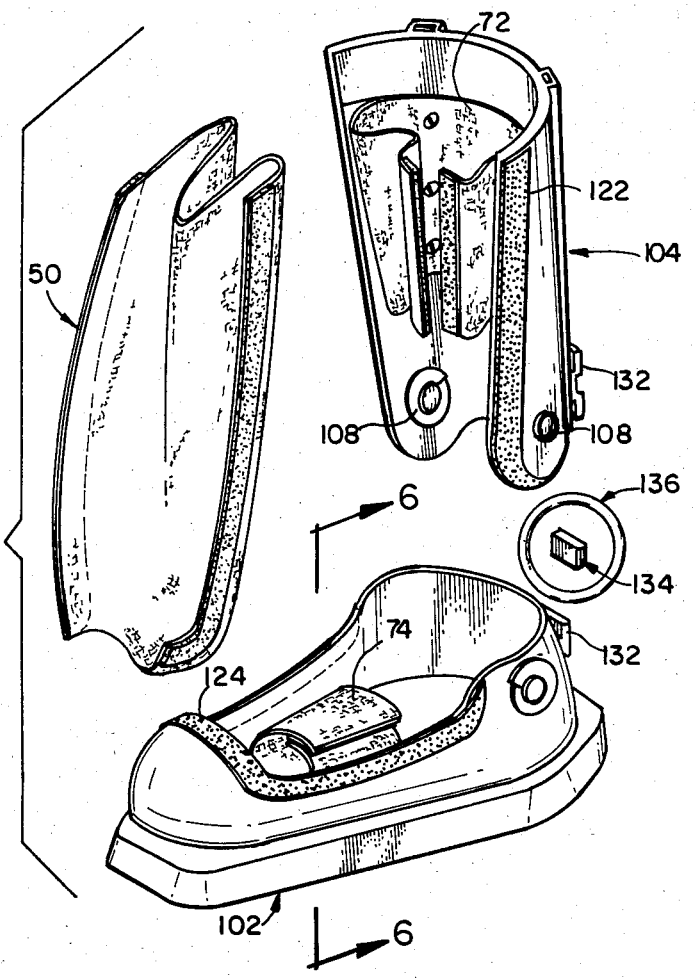
FIG. 5 is an exploded perspective view of the device of FIG. 3.

FIG. 5 illustrates the embodiment shown in FIGS. 3 and 4, in an exploded view. As seen in FIG. 5, leg portion 104 has belt 72 attached thereto and is affixed to shoe portion 102 by means of hinge pin 106, insertable in hinge hole 108. Resilient pad 134 and band 136 bias the boot into an upright position. Cover member 50, attaches over both shoe 102 and leg 104 portions, by means of additional hook and pile fasteners 76, mounted along the edges 122 of leg 104 and edges 124 of shoe 102.

Figure 9:
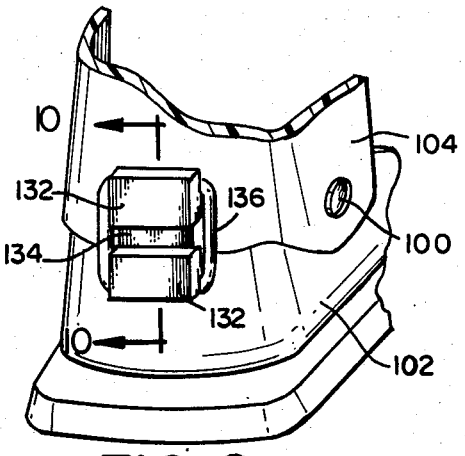
FIG. 9 is a partial perspective view of the embodiment of FIG. 3, from the rear.
Figure 10:
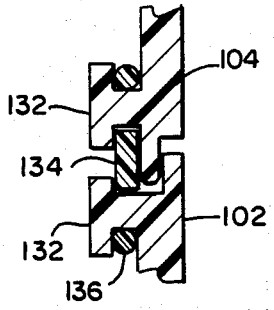
FIG. 10 is a partial section view along lines 10—10 in FIG. 9.

FIGS. 9 and 10 illustrate a particular connection by which flanges 132 bear inward on pad 134 during a backward leaning movement and bear outward on band 136 during a forward leaning movement. It will be appreciated that other biasing techniques can also be employed. Spring means for restricting the pivoting of articulated boots, and other alternatives are known in the art. It is also possible to interleave parts of the extending flanges 132 of the shoe and leg parts respectively, adapting them such that a forward pivoting movement will compress one pad and a backward pivot will compress another pad. A similar structure is possible with bands. Additional variations will occur to persons skilled in the art.

Figure 6:
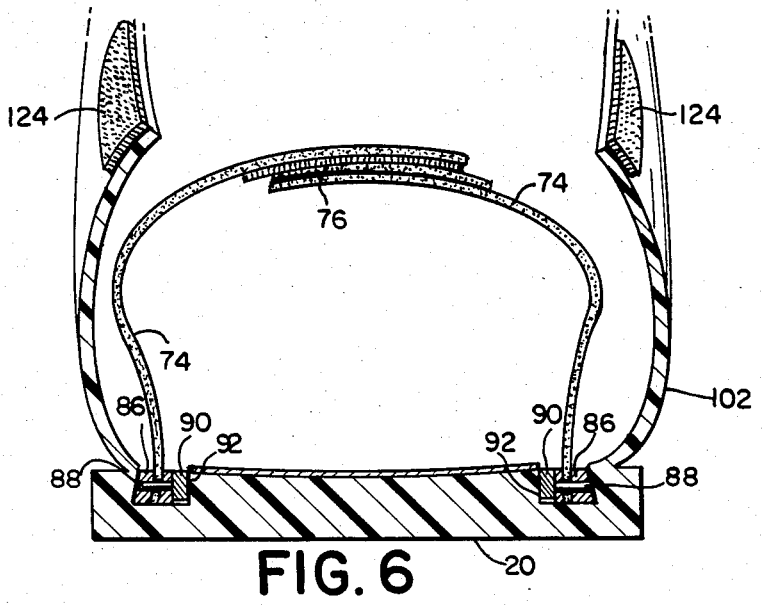
FIG. 6 is a section view taken along lines 6—6 in FIG. 5.
Figure 7:
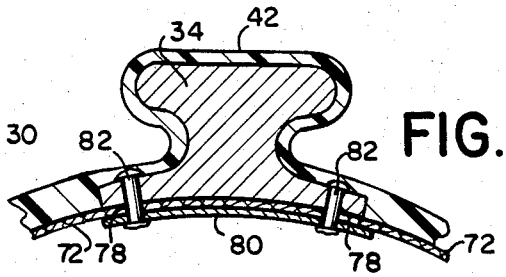
FIG. 7 is a partial section view taken along lines 7—7 in FIG. 2.

FIGS. 6–8 illustrate particulars of connection between belts 72, 74 and leg portion 104 and shoe portion 102, respectively. With reference to FIG. 6, lower belt 74 is preferably attached such that it can be positioned as required by the user anywhere along a range of positions in a forward and backward direction along sole block 20. For this purpose, elongated slots 92 are formed in sole block 20 for engaging the ends of belt 74 at any point. The slots preferably allow 1–3 inches of forward and backward adjustment to position belt 74 at a comfortable location on the user's instep. The slots 92 may be provided with serrations or detents (not shown) along their length such that the belt attachment cannot shift once affixed. Slots 92 are made with a trapezoidal cross section, that is, having one vertical wall and one slanting wall. The opening of the slot is therefore somewhat narrower than the width of the slot below the surface. The structure forms somewhat of a half-dovetail. Belts 74 are fixed to bars 86, which are also of trapezoidal cross section, slightly narrower than slots 92. Bars 86 fit up against the sloping walls of slots 92. Belt 74 may be connected to rods 86 by means of rivets 88 or the like. Spacers 90 are placed in slots 92 together with bars 86, thereby forcing bars 86 laterally against the sloping wall of slot 92. When spacers 90 are inserted, belts 74 cannot be withdrawn upwards from slot 92 due to the trapezoidal cross-section of the slot. This connecting structure is known as a "lewis" and was historically used for lifting blocks of stone. Insulation layer 94 can be provided over the sole block, and may partially cover slots 92 if desired.

Upper belt 72 may be attached to leg portion 104 in a similar manner, having ends spaced from the centerline as shown in FIG. 5. The upper belt 72 can also be attached at closer-spaced points than lower belt 74, as shown in FIG. 1. In an embodiment having one or two rear spines 42 and/or reinforcement bars 34 therein, belt 72 can be attached to the reinforcement bar(s) using rivets. As shown in FIG. 7, belt 72 can be attached between a connecting plate 80 and reinforcing bar 34 by means of rivets 82. Spacing the point of connection between the attached parts of belt 72 and the leg portion 104 serves to more tightly attach the user's leg to the rear and to more effectively rigidly connect the leg to the boot in the side-to-side plane. In the embodiment shown in FIG. 8, reinforcing spine 34 has been omitted, outer opposed plates 84 being attached by means of rivets 82 to inner plates 80, belt 72 being compressed between plates 82, 84 against the material of leg portion 104.

The invention having been disclosed, a number of variations will now occur to persons skilled in the art. Reference should be made to the appended claims rather than the foregoing specification as indicating the true scope of the invention.

What is claimed is:

1. A boot for supporting a user, comprising:

a sole block;

a first member forming a partial enclosure portion, fixed to the sole block and partially surrounding the user's foot at the toe, sides and back of the foot, the partial enclosure together with the sole block extending under and around the user's foot, and partially around a rear portion of the user's lower leg, the partial enclosure surrounding the foot and lower leg but for portions at a top of the foot and a front of the lower leg;

first belt means attached along edges of the sole block, the first belt means adapted to surround the user's foot at the instep, spaced forward from the user's ankle holding the foot block with respect to the sole block and exerting a downward pressure on the foot;

second belt means attached to the partial enclosure, the second belt means being spaced upwards from the sole block and surrounding the user's lower leg, the second belt means being adapted for fixing the user's lower leg to said partial enclosure, the second belt means exerting a rearward pressure on the lower leg; and, a second member forming a cover, removably attachable to the partial enclosure over said top of the foot and said front of the lower leg.

2. The boot of claim 1, wherein the second member is a weatherproof covering removably attachable to said first partial enclosure around complementary peripheral portions thereof.

3. The boot of claim 1, wherein the first and second belt means are continuously-adjustable belts having hook and pile interengaging structures.

4. The boot of claim 1, wherein at least one of said first and second belts is removably attachable to the respective sole block and first partial enclosure.

5. The boot of claim 1, wherein the second member is a vapor-porous, liquid-impermeable textile sheet.

6. The boot of claim 1, wherein said second member is attachable to the partial enclosure around complementary hook and pile engaging strips.

7. The boot of claim 1, wherein said first partial enclosure is articulated adjacent the user's ankle, along an axis extending horizontally through the ankle and defining a fore-and-aft pivoting direction, whereby the user is free to pivot fore-and-aft around the ankle and side-to-side tilting movements are transmitted precisely to the sole block.

8. The boot of claim 7, further comprising resilient biasing means restricting pivoting of said articulated portion around said axis.

9. The boot of claim 8, wherein said resilient biasing means restricts articulation in only one of the fore-and-aft directions.

10. The boot of claim 9, wherein said biasing is adjustable.

11. A boot for supporting a user, comprising:

a sole block;

a first member forming a partial enclosure portion, fixed to the sole block and partially surrounding the user's foot at the toe, sides and back of the foot, the partial enclosure together with the sole block extending under and around the user's foot, and partially around a rear portion of the user's lower leg, the partial enclosure surrounding the foot and lower leg but for portions at a top of the foot and a front of the lower leg, said partial enclosure being articulated adjacent the user's ankle, along an axis extending horizontally through the ankle and defining a fore-and-aft around the ankle and side-to-side tilting movements are transmitted precisely to the sole block, and resilient biasing means restricting pivoting of said articulated portion around said axis, said resilient biasing means restricting articulation in only one of the fore-and-aft directions, said first member being made of resilient plastic and articulated around a hinge axis having complementary helically inclined planes concentric with the axis, whereby rotation around the hinge axis is resisted;

first belt means attached along edges of the sole block, the first belt means adapted to surround the user's foot at the instep, spaced forward from the user's ankle holding the foot block with respect to the sole block and exerting a downward pressure on the foot;

second belt means attached to the partial enclosure, the second belt means being spaced upwards from the sole block and surrounding the user's lower leg, the second belt means being adapted for fixing the user's lower leg to said partial enclosure, the second belt means exerting a rearward pressure on the lower leg; and, a second member forming a cover, removably attachable to the partial enclosure over said top of the foot and said front of the lower leg.

* * * * *